US007484479B2

(12) United States Patent
Tsubouchi

(10) Patent No.: US 7,484,479 B2
(45) Date of Patent: Feb. 3, 2009

(54) WATER-COOLED INTERNAL COMBUSTION ENGINE

(75) Inventor: Masanori Tsubouchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 20 days.

(21) Appl. No.: 11/787,138

(22) Filed: Apr. 13, 2007

(65) Prior Publication Data

US 2007/0251227 A1 Nov. 1, 2007

(30) Foreign Application Priority Data

Apr. 28, 2006 (JP) ..... 2006-126605

(51) Int. Cl.
*F02F 1/36* (2006.01)
*F01P 7/14* (2006.01)

(52) U.S. Cl. ..... 123/41.82 R; 123/41.08; 440/88 J; 440/89 C

(58) Field of Classification Search ..... 123/195 HC, 123/195 P, 41.82 R, 41.82 A, 41.08; 60/321; 440/88 G, 88 J, 89 B, 89 C
See application file for complete search history.

(56) References Cited

U.S. PATENT DOCUMENTS 6,295,963 B1 * 10/2001 Kollock et al. ..... 123/195 HC
6,471,559 B2 * 10/2002 Kashima ..... 440/88 G
2002/0026909 A1 * 3/2002 Akiwa et al. ..... 123/41.82 R
2002/0072281 A1 * 6/2002 Takahashi ..... 440/88
2005/0087154 A1 * 4/2005 Hayman et al. ..... 60/321

FOREIGN PATENT DOCUMENTS

JP 10-220283 * 8/1998

* cited by examiner

*Primary Examiner*—Noah Kamen
(74) *Attorney, Agent, or Firm*—Carrier, Blackman & Associates, P.C.; William D. Blackman; Joseph P. Carrier

(57) ABSTRACT

A water-cooled internal combustion engine E is provided with a cylinder block water jacket $J_b$, a cylinder head water jacket $J_h$, and an exhaust manifold passage 38 in which exhaust gas discharged from combustion chambers 26 through exhaust ports 28 collects. The exhaust manifold passage 38 is formed only in a cylinder head 21. The exhaust gas that has collected in the exhaust manifold passage 38 is discharged through an exhaust outlet of the exhaust manifold passage 38 from a cylinder head 21 into an exhaust passage 39 formed in a cylinder block C. The exhaust manifold passage 38 is surrounded by the cylinder head water jacket $J_h$, the cylinder block water jacket $J_b$ and a discharge water jacket 80 for carrying cooling water from the cylinder head water jacket $J_h$ and the cylinder block water jacket $J_b$ to the outside of the engine body. The engine E provided with the exhaust manifold passage 38 does not require any assembling work for sealing the exhaust manifold passage 38 and hence the cost of the combustion engine E can be reduced. A wall defining the exhaust manifold passage 38 can be efficiently cooled by the cooling water that flows through the water jackets.

9 Claims, 10 Drawing Sheets

WATER-COOLED INTERNAL COMBUSTION ENGINE

BACKGROUND OF THE INVENTION

1. Field of the Invention

The present invention relates to a water-cooled internal combustion engine cooled by cooling water and, more specifically, to water jackets formed in the cylinder block and the cylinder head of a water-cooled internal combustion engine. The internal combustion engine is intended to be incorporated into, for example, an outboard motor.

2. Description of the Related Art

There has been known a water-cooled internal combustion engine for an outboard motor, which has a cylinder block provided with an exhaust manifold passage in which exhaust gas discharged from a plurality of combustion chambers through exhaust ports collects and which has water jackets formed around the exhaust manifold passage. Such a water-cooled internal combustion engine is disclosed in, for example, Japanese Patent Application Publication No. 10-220283.

When the exhaust manifold pass age is formed in the cylinder block, the inlet to the exhaust manifold passage is formed in the joint surface of the cylinder block so as to extend along the arrangement of cylinders to connect the exhaust manifold passage respectively to the exhaust ports of the combustion chambers. When the cylinder head is joined to the joint surface of the cylinder block, parts of the cylinder head around the inlet to the exhaust manifold passage need to be fastened to the cylinder block with many bolts to seal the inlet of the exhaust manifold passage. Use of many bolts to fasten the cylinder head to the cylinder block requires much assembling work and increases the cost. If the water jackets formed around the exhaust manifold passage are divided into parts by those bolts, the water jackets cannot bring their cooling ability into full play.

SUMMARY OF THE INVENTION

The present invention has been made under such circumstances and it is therefore an object of the present invention to reduce the cost of a water-cooled internal combustion engine provided with an exhaust manifold passage by reducing assembling work for sealing the exhaust manifold passage and to improve the effect of water jackets on cooling walls defining the exhaust manifold passage. Another object of the present invention is to form a cylinder head provided with a thermostat valve, and a cylinder block provided with cylinders respectively in small sizes with respect to a direction in which cylinders are arranged. Hereinafter, the direction in which the cylinders are arranged will be referred to as "cylinder arranging direction".

To achieve this object, the present invention provides a water-cooled internal combustion engine comprising:

an engine body having: a cylinder block provided with a plurality of cylinders arranged in a cylinder arranging direction; a cylinder head joined to the cylinder block and provided with a plurality of combustion chambers respectively corresponding to the cylinders and with exhaust ports connected to combustion chambers, respectively; and a water pump for pumping cooling water; the cylinder block having a cylinder block water jacket surrounding the cylinders, the cylinder head being provided with a cylinder head water jacket surrounding the combustion chambers and the exhaust ports, and with an exhaust manifold passage into which exhaust gas flows from the combustion chambers through the exhaust ports, respectively:

wherein the exhaust manifold passage is formed only in the cylinder head and has an exhaust gas outlet through which the exhaust gas collected in the exhaust manifold passage flows out from the cylinder head; and the exhaust manifold passage is surrounded by the cylinder head water jacket and a discharge water jacket formed in the cylinder head and connected to the cylinder block water jacket and the cylinder head water jacket in such a manner that cooling water from the cylinder block water jacket and the cylinder head water jacket is discharged to the outside of the engine body through the discharge water jacket.

According to the present invention, the exhaust manifold passage does not need to be sealed to connect the exhaust manifold passage to the exhaust ports because the exhaust manifold passage is formed only in the cylinder head. Since the exhaust gas collected in the exhaust manifold passage is discharged through the exhaust gas outlet, only a comparatively small area around the exhaust gas outlet needs to be sealed. Thus the exhaust manifold passage can be sealed by only a little assembling work, which is effective in reducing the cost of the water-cooled internal combustion engine. The cylinder head water jacket and the discharge water jacket are formed around the exhaust manifold passage and those water jackets are not divided into parts by bolts. Consequently, walls defining the exhaust manifold passage can be efficiently cooled.

Preferably, the cylinder block water jacket communicates with the discharge water jacket by means of a cylinder block connecting passage, in which a cylinder block thermostat valve is held so as not to protrude from the cylinder block in the cylinder arranging direction, and the cylinder head water jacket communicates with the discharge water jacket by means of a cylinder head connecting passage, in which a cylinder head thermostat valve is held so as not to produce from the cylinder had in the cylinder arranging direction.

Thus the cylinder block thermostat valve and the cylinder head thermostat valve do not protrude from the cylinder block and the cylinder head, respectively, in the cylinder arranging direction and hence the respective dimensions of the cylinder block and the cylinder head with respect to the cylinder arranging direction are small.

Preferably, the cylinder block is provided with a cylinder block exhaust passage connecting to the exhaust gas outlet in a joint surface of the cylinder block to which the cylinder head is joined, and the cylinder block exhaust passage is surrounded on four sides by a supply water passage through which the cooling water pumped by the water pump is supplied into the cylinder head water jacket, a discharge water passage through which the cooling water from the discharge water jacket flows, and the cylinder block water jacket.

A wall defining the cylinder block exhaust passage can be efficiently cooled because the cylinder block exhaust passage is surrounded on four sides by the supply water passage, the discharge water passage and the cylinder block water jacket.

The discharge water jacket may be formed between a recess formed in the wall defining the exhaust manifold passage formed in the cylinder head, and a cover attached to the cylinder head so as to cover the recess.

DESCRIPTION OF THE PREFERRED EMBODIMENTS

A water-cooled internal combustion engine in a preferred embodiment of the present invention will be described with reference to FIGS. 1 to 10.

Figure 1:
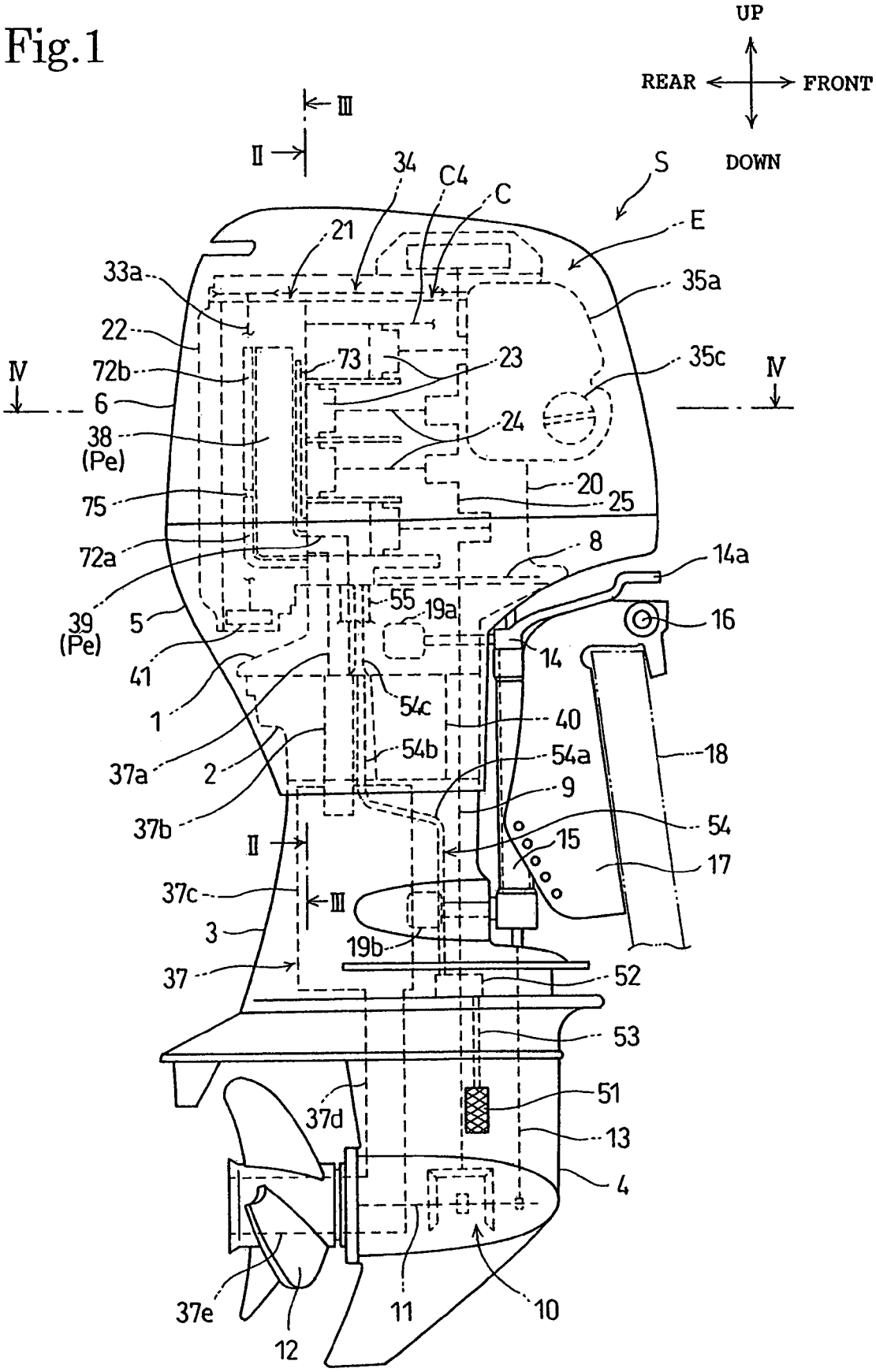
FIG. 1 is a schematic side elevation of an outboard motor provided with a water-cooled internal combustion engine in a preferred embodiment of the present invention taken from the right-hand side of the outboard motor.

Referring to FIG. 1, the water-cooled internal combustion engine generally indicated E is incorporated into an outboard motor S, namely, a marine propulsion device. The outboard motor S includes the water-cooled internal combustion engine E, namely, a vertical engine, provided with a vertical crankshaft 25, a mount case 1 having an upper end joined to the lower end of the engine E, an oil case 2 joined to the lower end of the mount case 1, an extension case 3 connected by the oil case 2 to the mount case 1, a gear case 4 joined to the lower end of the extension case 3, a vertically extending under cover 5 surrounding a lower part of the engine E, the mount case 1, the oil case 2 and an upper part of the extension case 3, and an engine cover 6 detachably attached to the upper end of the under cover 5.

In this specification, the terms "vertical", "longitudinal" and "lateral" are used for indicating directions, positions and such in relation with the outboard motor S mounted on a hull 18.

A power transmission system for transmitting the power of the engine E of the outboard motor S to a propeller 12 includes a flywheel 8 mounted on a lower end part of the crankshaft 25, a drive shaft 9 connected to the lower end of the crankshaft 25 for rotation together with the flywheel 8, a reversing mechanism 10 formed in the gear case 4 and including a bevel gear mechanism and a clutch mechanism, and a propeller shaft 11 on which the propeller 12 is mounted. The drive shaft 9 extends vertically downward from the interior of the mount case 1 through the extension case 3 into the gear case 4. The drive shaft 9 is connected through the reversing mechanism 10 to the propeller shaft 11. The reversing mechanism 10 is operated by turning a shift rod 13 extended through a swivel shaft 14 to set the reversing mechanism 10 selectively in a forward propulsion state or a backward propulsion state. The power of the water-cooled internal combustion engine E is transmitted from the crankshaft 25 through the drive shaft 9, the reversing mechanism 10 and the propeller shaft 11 to the propeller 12 to drive the propeller 12 for rotation.

A mounting device for mounting the outboard motor S on the hull 18 has the swivel shaft 14 provided with an operating member 14*a*, a swivel case 15 supporting the swivel shaft 14 for turning thereon, a tilting shaft 16 supporting the swivel shaft 14 so as to be turnable, and a bracket 17 holding the tilting shaft 16 and attached to the stem frame of the hull 18. The swivel shaft 14 has an upper end part fixedly held on the mount case 1 by a mount rubber 19*a*, and a lower end part fixedly held on the extension case 3 by a mount rubber 19*b*. The mounting device holds the outboard motor S so as to be turnable on the tilting shaft 16 in a vertical plane relative to the hull 18 and so as to be turnable on the swivel shaft 14 in a horizontal plane.

Figure 2:
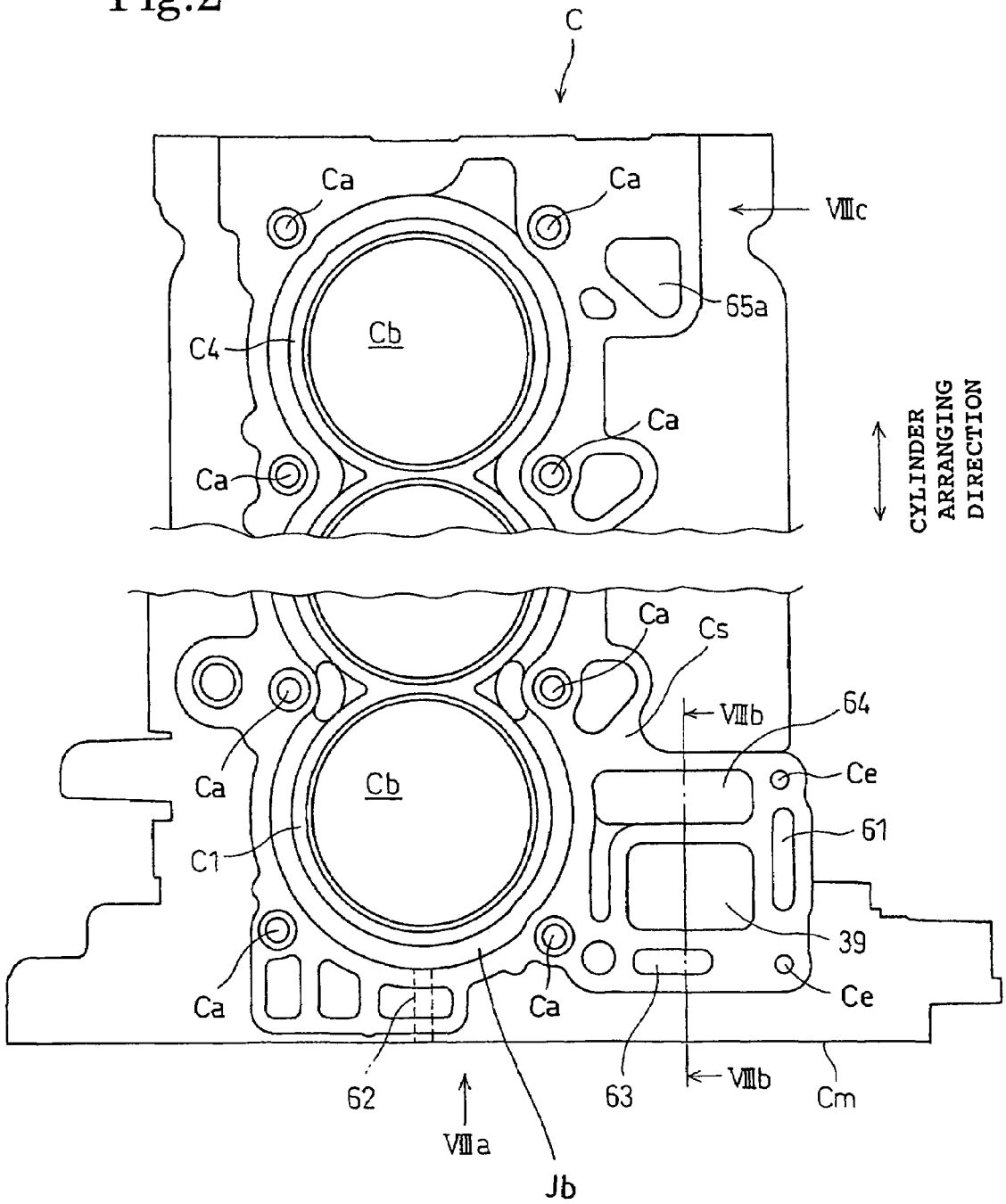
FIG. 2 is a sectional view of a cylinder block of the water-cooled internal combustion engine, taken on the line II-II in FIG. 1.
Figure 3:
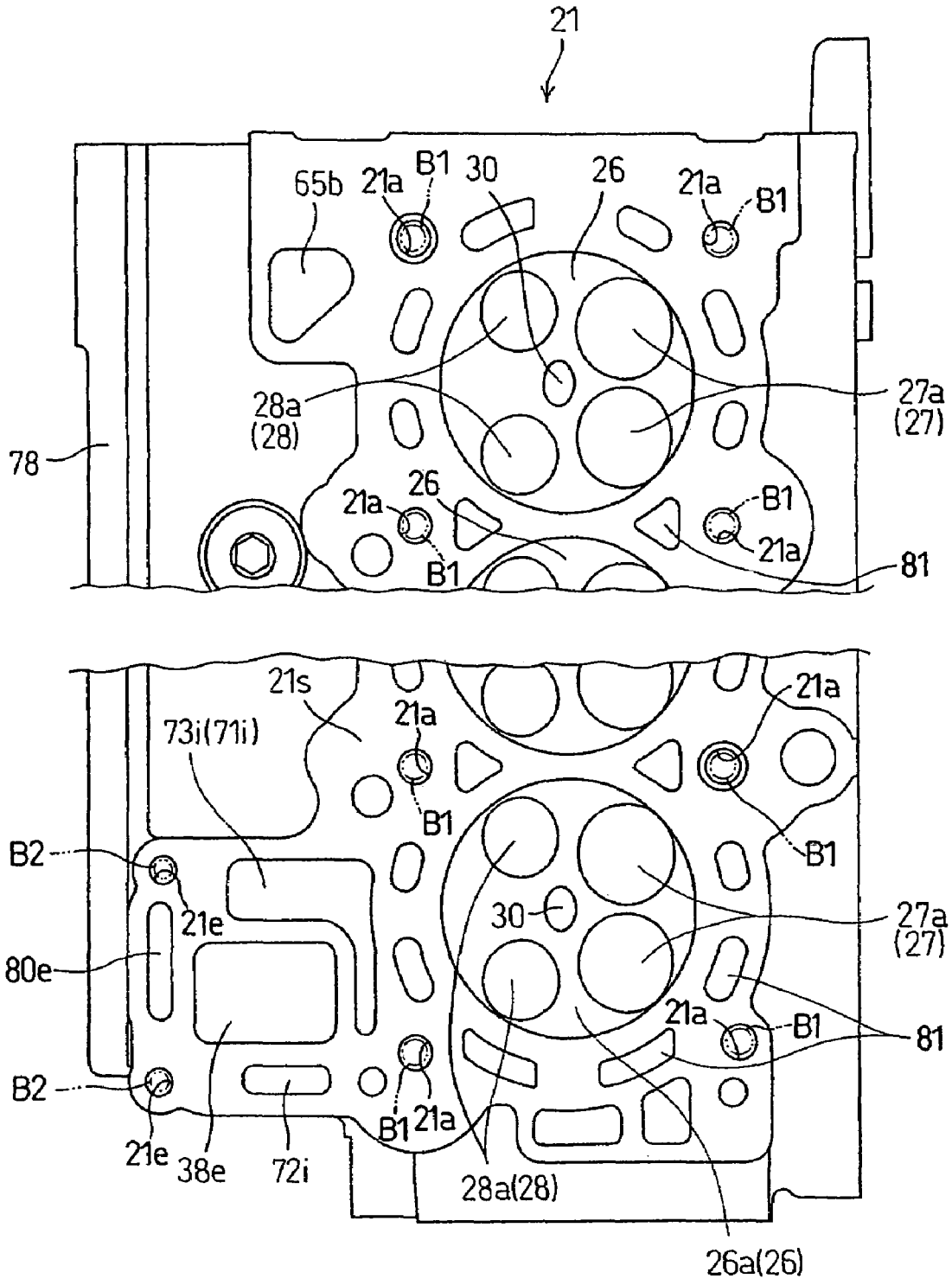
FIG. 3 is a sectional view of a cylinder head included in the water-cooled internal combustion engine taken on the line III-III in FIG. 1.
Figure 4:
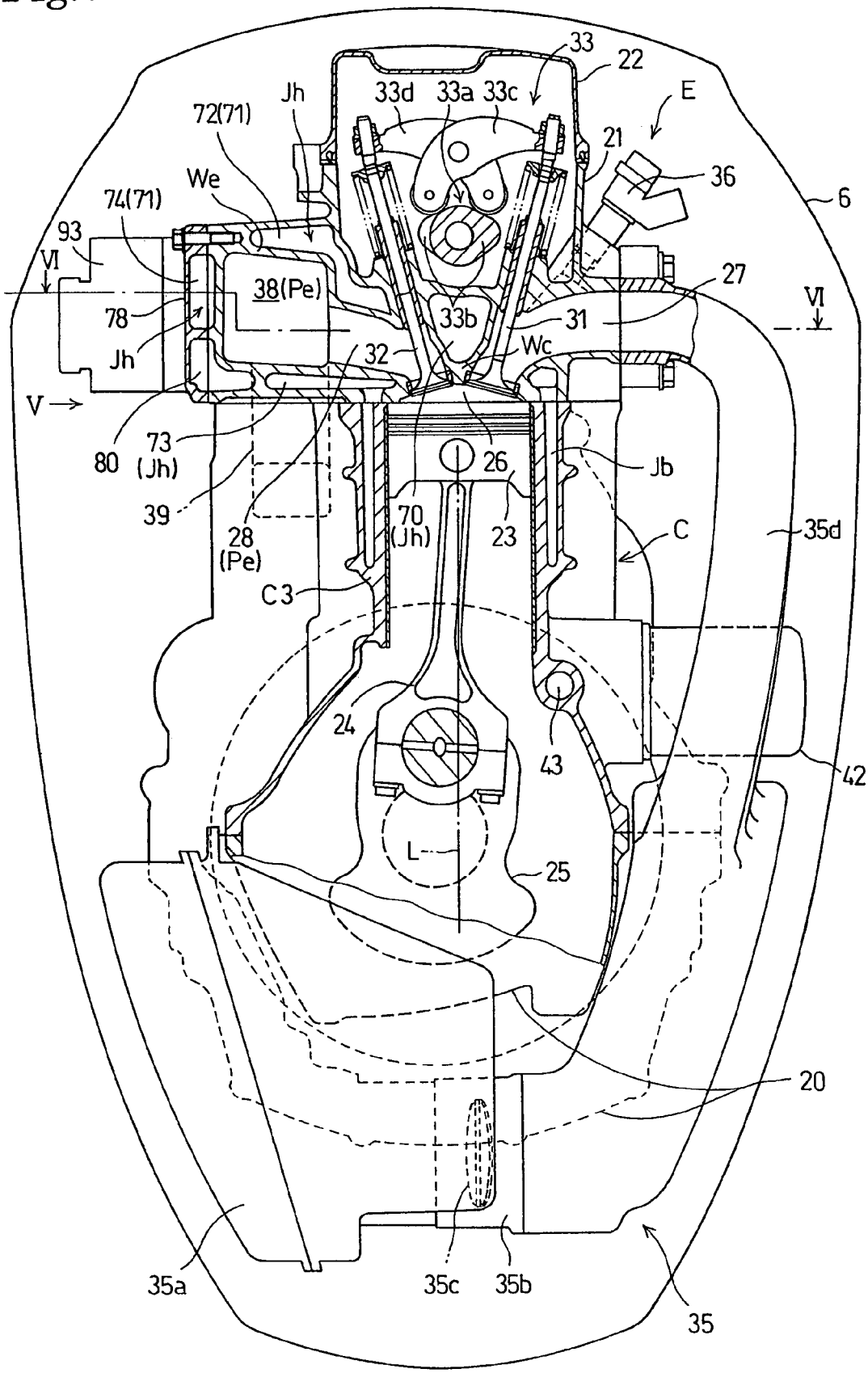
FIG. 4 is a schematic sectional view taken on the line IV-IV in FIG. 1.

Referring also to FIGS. 2 to 4, the water-cooled internal combustion engine E, which is a multiple-cylinder four-stroke internal combustion engine, has an engine body including a cylinder block C provided with four vertically arranged cylinders C1 to C4, a crankcase 20 joined to the front end surface of the cylinder block C, a cylinder head 21 joined to the rear end surface of the cylinder block C with a gasket held between the cylinder block C and the cylinder head 21, and a head cover 22 attached to the rear end of the cylinder head 21.

The cylinder head 21 is fastened to the cylinder block C with bolts B1 (FIG. 3) and bolts B2. The bolts B1 and B2 are passed through bolt holes arranged around combustion chambers 26 (FIG. 4) and bolt holes 21*e* arranged around an exhaust gas outlet 38*e* (FIG. 3) and are screwed into threaded holes $C_a$ arranged around the cylinders C1 to C4 and threaded holes $C_e$ arranged around an exhaust passage 39, respectively.

Pistons 23 (FIG. 4) are axially slidably fitted in the cylinders C1 to C4 and are connected to the crankshaft 25 by connecting rods 24, respectively. The crankshaft 25 is supported for rotation on the cylinder block C and the crankcase 20.

The cylinder head 21 is provided with the combustion chambers 26 respectively facing the pistons 23 fitted in the cylinders C1 to C4 with respect to a direction parallel to the axes L of the cylinders C1 to C4, intake ports 27 each having a pair of intake openings 27*a* opening into the combustion chamber 26, exhaust ports 28 each having a pair of exhaust openings 28*a* opening into the combustion chamber 26, and spark plug holding bores 30 (FIGS. 5 and 7) respectively for holding spark plugs 29. Hereinafter, the direction parallel to the axes L of the cylinders C1 to C4 will be referred to as "cylinder axis direction".

The cylinder head 21 is provided with intake valves 31 respectively for closing and opening the intake openings 27*a*, and exhaust valves 32 respectively for closing and opening the exhaust ports 28*a*. The intake valves 31 and the exhaust valves 32 are opened and closed in synchronism with the rotation of the crankshaft 25 by an overhead-camshaft type valve train 33 disposed in a valve train chamber defined by the cylinder head 21 and the head cover 22. The valve train 33 includes a camshaft 33*a* provided with cams 33*b* (FIG. 4), intake rocker arms 33*c* driven by the cams 33*b*, and exhaust rocker arms 33*d* driven by the cams 33*b*. The camshaft 33*a* is rotatably supported on the cylinder head 21 and is driven for rotation by the crankshaft 25 through a transmission mechanism 34 (FIG. 1) including a timing chain. The intake valves 31 and the exhaust valves 32 are driven for opening and closing through the intake rocker arms 33*c* and the exhaust rocker arms 33*d*, respectively, by the cams 33*b*.

Referring to FIGS. 1 and 4, the water-cooled internal combustion engine E is provided with an intake system 35. The intake system 35 includes an inlet air silencer 35*a* having an air inlet, a throttle body 35*b* disposed in front of the crankcase 20, a throttle valve 35*c* placed in the throttle body 35*b* to control intake air, and an intake manifold 35*d*, namely, an intake pipe for carrying intake air metered by the throttle valve 35*c* to the intake ports 27. Air taken in through the inlet air silencer 35*a* flows through the throttle body 35*b*. The intake air flowing through an intake passages in the intake system 35 and the intake ports 27 is mixed with fuel spouted by each of fuel injection valves 36 attached to the cylinder head 21 to produce an air-fuel mixture. The air-fuel mixture is sucked through the intake port 27 into the combustion chamber 26. The air-fuel mixture taken into the combustion chamber 26 is ignited by the spark plug 29. The air fuel mixture burns to produce a combustion gas. The piston 23 is driven for reciprocation by the pressure of the combustion gas. The reciprocating piston 23 drives the crankshaft 25 for rotation through the connecting rod 24. The combustion gas is discharged as an exhaust gas from the combustion chamber 26 into an exhaust passage $P_e$ including the exhaust ports 28. The exhaust gas flows through an exhaust guide passage 37 and is discharged to the outside of the outboard motor S.

The exhaust guide passage 37 guides the exhaust gas flowing through the exhaust passage $P_e$ to the outside of the outboard motor S. As shown in FIG. 1, the exhaust guide passage 37 includes a passage 37*a* formed in the mount case 1, a passage 37*b* defined by an exhaust guide pipe, an expansion chamber 37*c* formed in the extension case 3, a passage 37*d* formed in the gear case 4, and a passage 37*e* formed in the boss of the propeller 12 to discharge the exhaust gas flowing through the passage 37*d* into the water.

Referring to FIG. 4, the exhaust passage $P_e$ formed in the engine body includes a cylinder head exhaust passage formed in the cylinder head 21 and a cylinder block exhaust passage 39 (FIG. 2) provided in the cylinder block C. The cylinder head exhaust passage includes the exhaust ports 28 and an exhaust manifold passage 38 connected to the exhaust ports 28. The exhaust gas flows through the exhaust ports 28 into the exhaust manifold passage 38.

Figure 7:
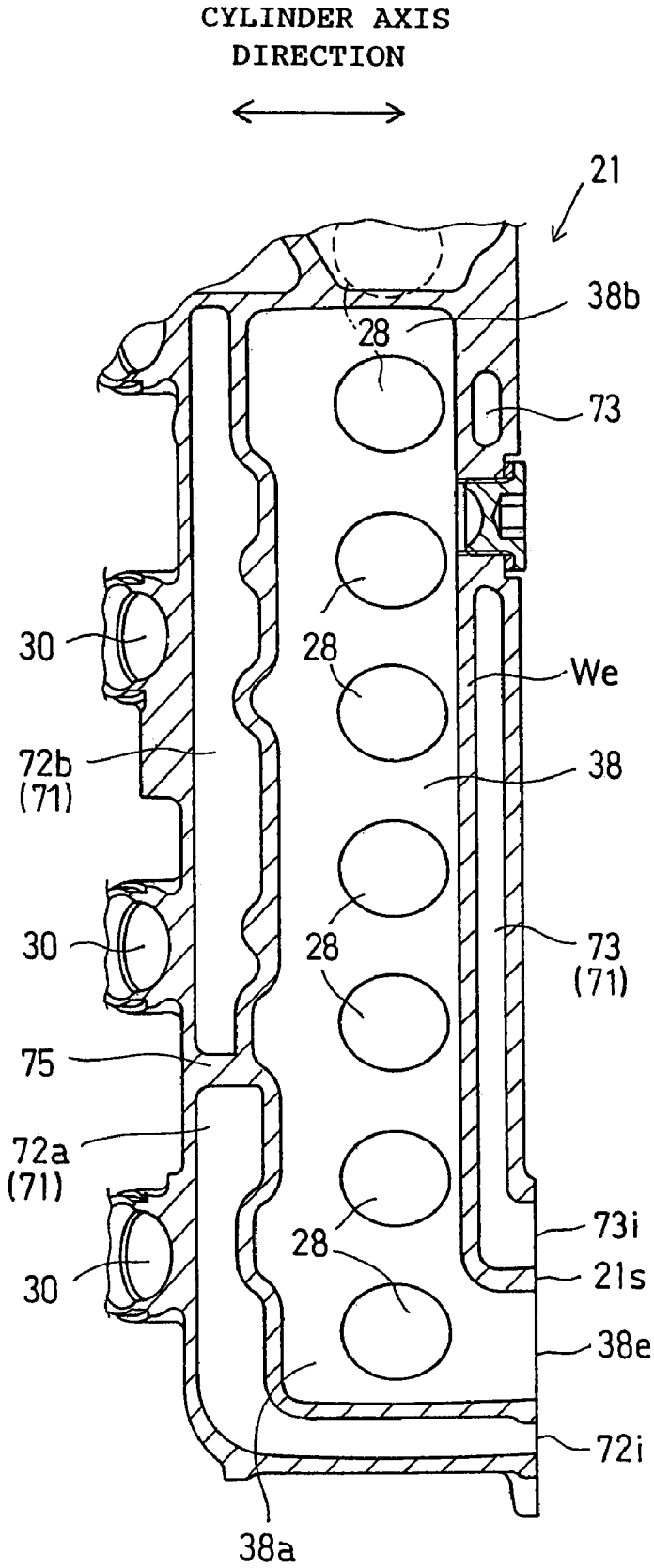
FIG. 7 is a schematic sectional view taken on the line VII-VII in FIG. 6.

As shown in FIG. 7, the exhaust manifold passage 38 is defined by walls $W_e$. The exhaust manifold passage 38 is formed only in the cylinder head 21. The exhaust manifold passage 38 extends in a cylinder arranging direction, namely, a cylinder arranging direction parallel to the center axis of the crankshaft 25, in a range corresponding to all the combustion chambers 26 respectively corresponding to the cylinders C1 to C4. The exhaust gas outlet 38*e* is formed in a lower end part 38*a* at one end of the exhaust manifold passage 38 so as to open into the joint surface 21*s* of the cylinder head 21 to which the cylinder block C is joined.

A downward direction or an upward direction is either of opposite directions parallel to the cylinder arranging direction. For example, a lower end part is one of the opposite end parts with respect to the cylinder arranging direction, and an upper end part is the other end part with respect to the cylinder arranging direction.

Figure 9:
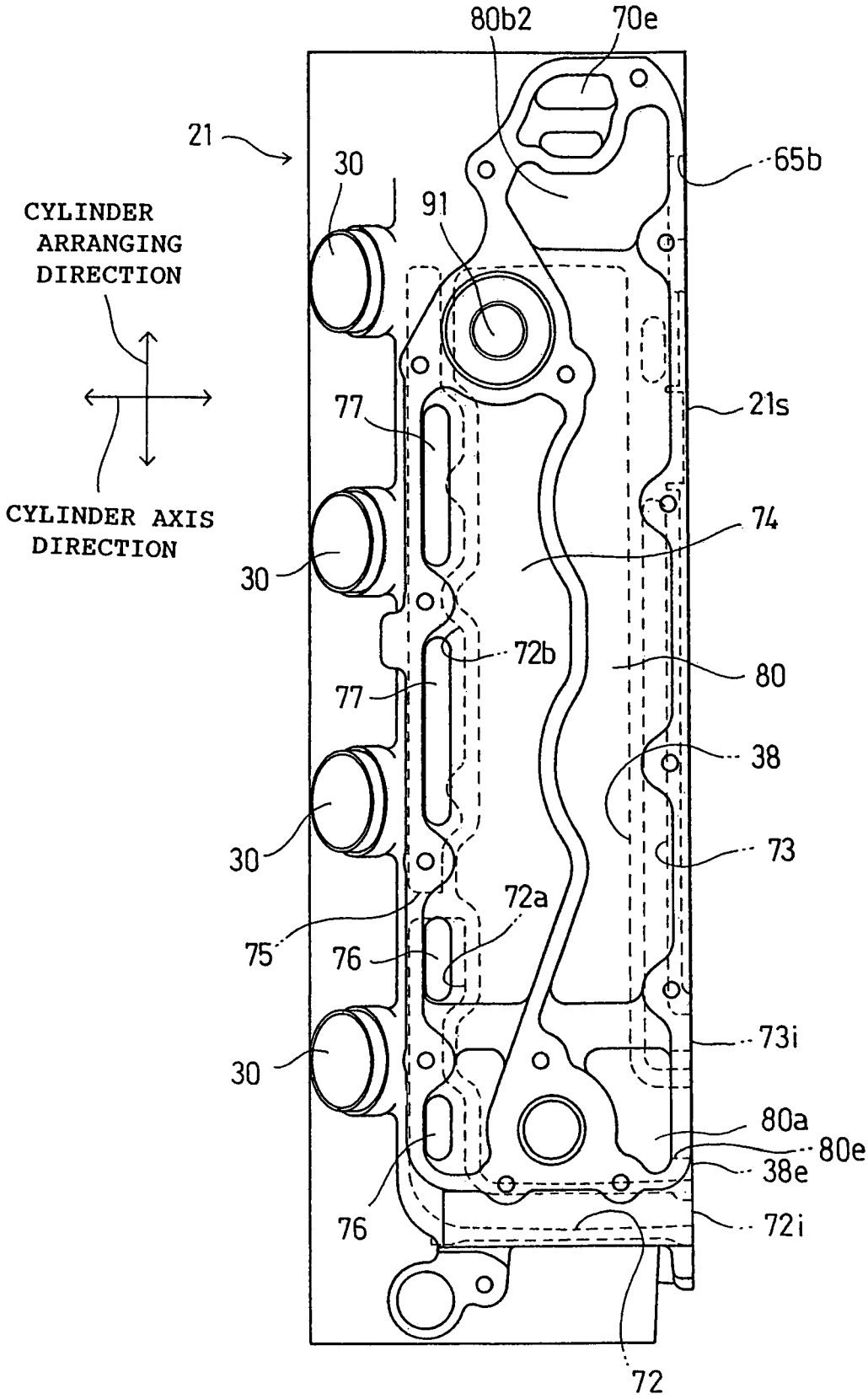
FIG. 9 is a view taken in the direction of the arrow IX in FIG. 6.

As shown in FIG. 9, a through hole 91 is formed in the wall $W_e$. An exhaust gas sensor 92 (FIG. 6) passed through an opening formed in a cover 78 is inserted in the through hole 91. The exhaust gas sensor 92 measures properties of the exhaust gas flowing through the exhaust manifold passage 38.

Referring to FIGS. 2, 5 and 8A to 8C, an L-shaped exhaust passage 39 formed in a lower end part of the cylinder block C connects to the exhaust gas outlet $38_e$ in the joint surface $C_s$ of the cylinder block C to which the cylinder head 21 is joined and connects to the passage 37*a* (FIG. 1) formed in the mount case 1 in the joint surface $C_m$ of the mount case 1. The exhaust gas discharged from the combustion chambers 26 and collected in the exhaust manifold passage 38 flows from the cylinder head 21 through the exhaust gas outlet 38*e* into the exhaust passage 39, flows through the exhaust passage 39, the passage 37*a* and the exhaust guide passage 37, and is discharged into the water.

Referring to FIGS. 1 and 4, the water-cooled internal combustion engine E is provided with a lubrication system including an oil pan 40 placed in the oil case 2, an oil pump 41 held on the cylinder head 21 and driven by the camshaft 33*a* supported on the cylinder head 21, and a number of oil passages. The oil pump 41 pumps up oil from the oil pan 40 through a suction oil passage formed in the mount case 1, the cylinder block C and the cylinder head 21. The oil discharged from the oil pump 41 flows through a discharge oil passage formed in the cylinder head 21 and the cylinder block C and an oil filter 42 into a main oil gallery 43 (FIG. 4). The oil that flows into the main oil gallery 43 is distributed to moving parts in the cylinder block C, the crankcase 20 and the cylinder head 21. The used oil flows through return passages formed in the cylinder block C, the cylinder head 21 and the mount case 1 and returns to the oil pan 40.

Referring to FIG. 1, the engine E is provided with a cooling system including a water intake 51 formed in the gear case 4 so as to be submerged in the water, a water pump 52 disposed in the extension case 3 and rotatively driven by the drive shaft 9, a water intake passage 53 formed through the gear case 4 and the extension case 3 to carry cooling water sucked through the water intake 51 to the water pump 52, a water supply passage 54 formed through the extension case 3, the oil case 2 and the mount case 1 to carry the cooling water pumped by the water pump 52 to the engine E, a cooling water passage system formed in the engine body to receive the cooling water from the water supply passage 54, a discharge water passage 55 provided in the mount case 1, through which the cooling water that has cooled the engine body flows into the extension case 3, and thermostat valves 56 and 57 (FIG. 5) placed in the cooling water passage system.

Figure 8A:
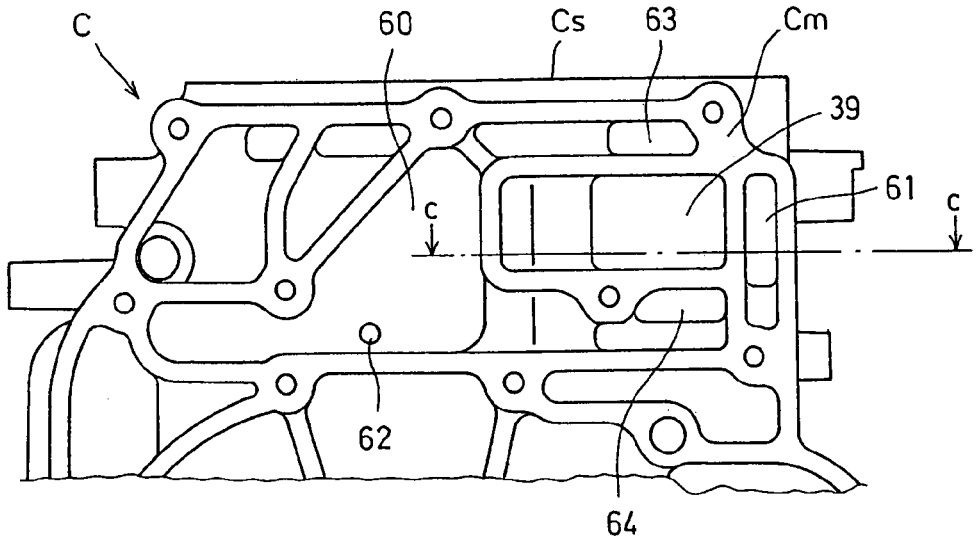
FIG. 8A is a view of an essential part shown in FIG. 2, taken in the direction of the arrow VIIIa in FIG. 2.
Figure 8B:
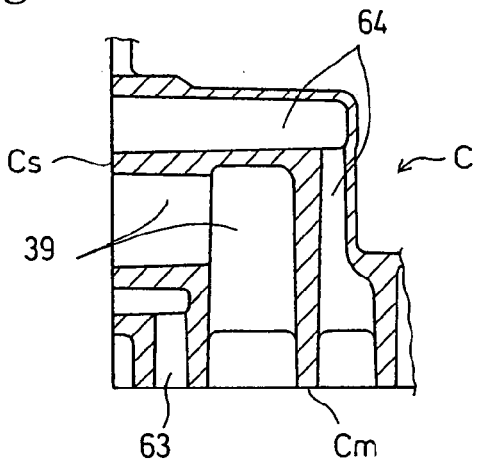
FIG. 8B is a sectional view taken on the line VIIIb-VIIIb in FIG. 2.
Figure 8C:
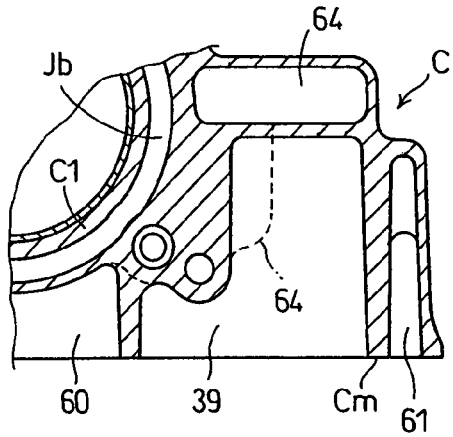
FIG. 8C is a sectional view taken on the line c-c in FIG. 8A.
Figure 8D:
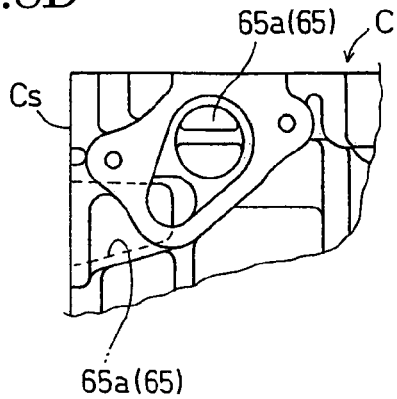
FIG. 8D is a view of an essential part shown in FIG. 2 taken in the direction of the arrow VIIId in FIG. 2.
Figure 8E:
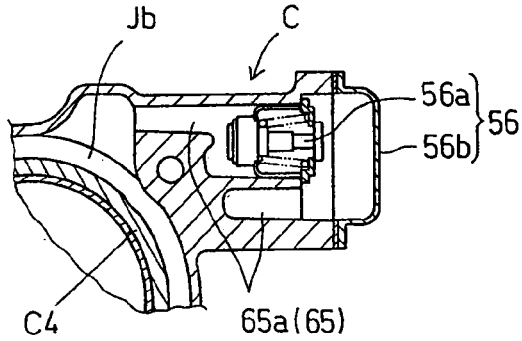
FIG. 8E is a sectional view taken on the line VIIIe-VIIIe in FIG. 5.

The water supply passage 54 includes a water passage 54*a* made of a pipe extending upward from the water pump 52, and water passages 54*b* and 54*c* provided in the oil case 2 and the mount case 1, respectively, to lead the cooling water from the water passage 54*a* to a water inlet 60 (FIG. 8A).

Referring to FIGS. 2, 4, 6 and 10, the cooling water passage system includes the water inlet 60 (FIG. 8A), namely, a recess formed in the joint surface $C_m$ of the cylinder block C, for receiving the cooling water from the water supply passage 54, a cylinder block water jacket $J_b$ (FIG. 4) surrounding the cylinder bores $C_b$ of the cylinders C1 to C4, a cylinder head water jacket $J_h$ formed in the cylinder head 21 so as to cover the combustion chambers 26, the exhaust ports 28 and the exhaust manifold passage 38, an outlet water passage 61 formed in the cylinder block C so as to open in the joint surface $C_m$ of the cylinder block C to discharge the cooling water from the cooling water passage system into the discharge passage 55 formed in the mount case 1, and a number of water passages formed in the cylinder block C and the cylinder head 21.

Figure 10:
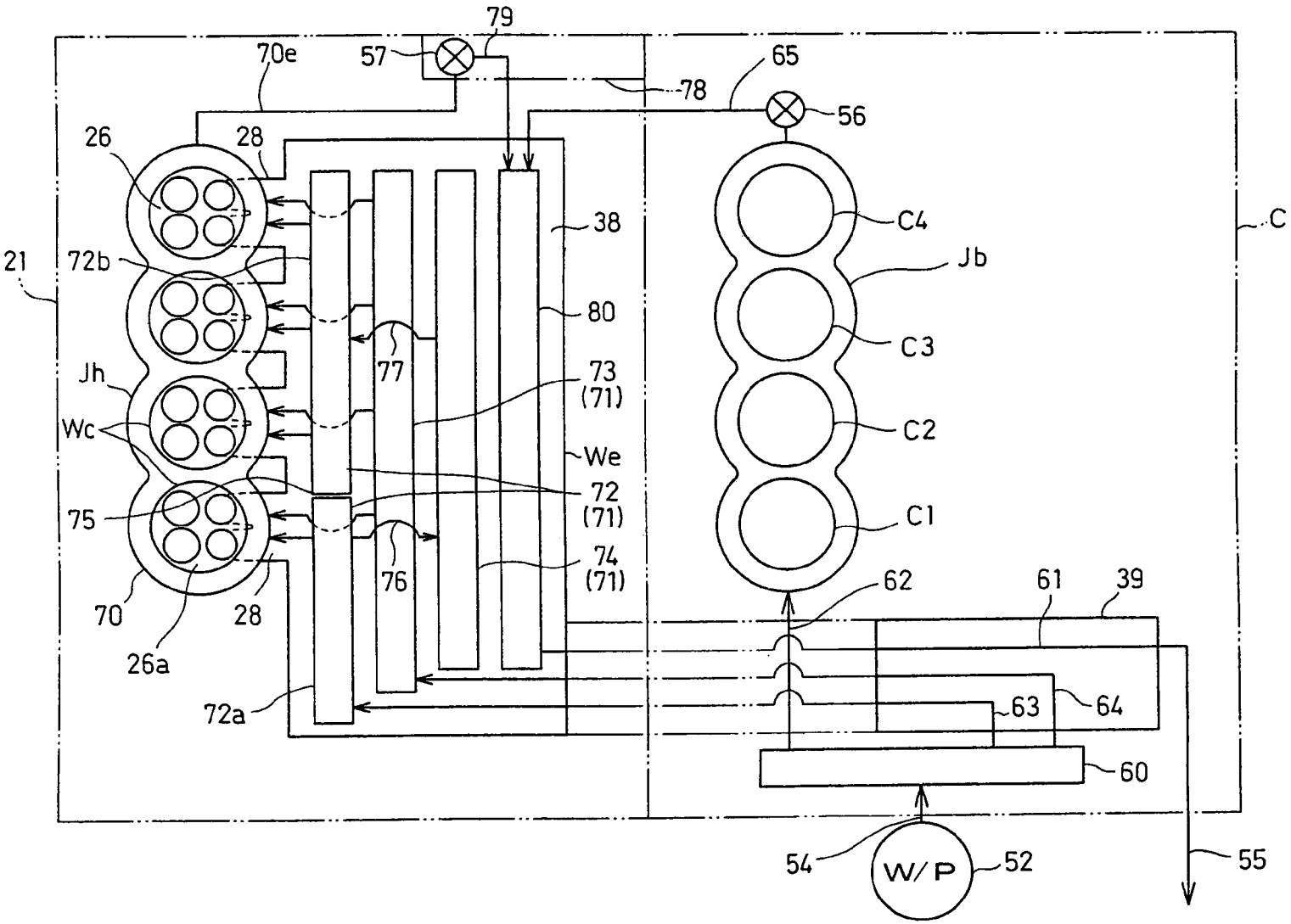
FIG. 10 is a typical view of a cooling system of the water-cooled internal combustion engine shown in FIG. 1.

Referring to FIGS. 2, 8 and 10, a first inlet water passage 62, a second inlet water passage 63 and a third inlet water passage 64 (FIG. 10) formed in the cylinder block C connect to the water inlet 60. The cooling water pumped by the water pump 52 flows into the inlet water passages 62, 63 and 64. The first inlet water passage 62 has an outlet connecting to the water jackets $J_b$ to carry the cooling water from the water inlet 60 into the water jackets $J_b$. The cooling water that has flowed through the water jackets $J_b$ and cooled the cylinders C1 to C4 flows through a cylinder block connecting passage 65 into a discharge water jacket 80 (FIGS. 4 and 9) formed in the cylinder head 21. The cylinder block connecting passage 65 interconnecting the water jackets $J_b$ and the discharge water jacket 80 includes an upstream water passage 65*a* (FIGS. 8D and 8E) formed in the cylinder block C, having an inlet opening into the water jackets $J_b$ and an outlet opening in the joint surface $C_s$ and provided with a cylinder block thermostat valve 56, and a downstream water passage 65*b* (FIGS. 3, 6 and 9) formed in the cylinder head 21, having an inlet opening in the joint surface 21*a* and an outlet opening into the discharge water jacket 80, and connected to the upstream water passage 65*a*. The cylinder block thermostat valve 56 has a valve unit 56*a* and a thermostat cover 56*b*. The cylinder block thermostat valve 56 does not protrude upward in the cylinder arranging direction from the cylinder block C.

Referring to FIGS. 2, 5, 8A, 8B and 8C, the second inlet water passage 63 and the third inlet water passage 64, which are L-shaped holes extending along the exhaust passage 39, have outlets opening in the joint surface $C_s$.

Through holes formed in the gasket and sealing the joint between the joint surfaces 21*s* and $C_s$ permits the cooling water to flow through the joint.

Figure 5:
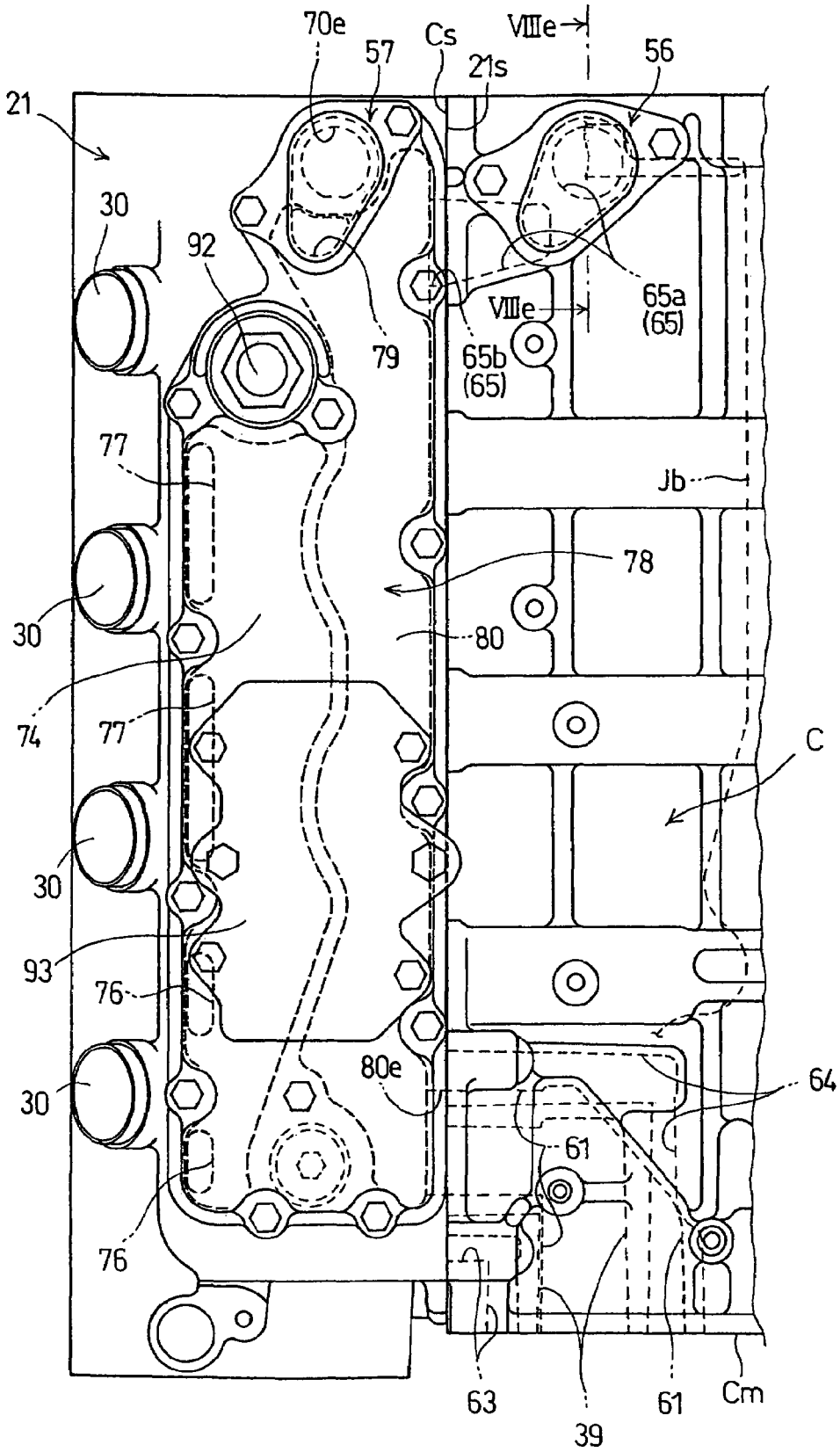
FIG. 5 is a view of an essential part shown in FIG. 4, taken in the direction of the arrow V.

Referring to FIGS. 2, 5 and 8A, the exhaust passage 39 is surrounded on four sides by the inlet water passage 63 and 64, the outlet water passage 61 and the cylinder block water jacket $J_b$. More concretely, as obvious from FIG. 2 best showing a cross section of the exhaust passage 39, the second inlet water passage 63 and the third inlet water passage 64 extend along the opposite sides of the exhaust passage 39 with respect to first opposite directions, and the cylinder block water jacket $J_b$ and the outlet water passage 61 extend along the opposite sides of the exhaust passage 39 with respect to second opposite directions perpendicular to the first opposite directions. As shown in FIG. 8A, the water inlet 60 extends around the sides of a part of the exhaust passage 39 near the outlet of the exhaust passage 39 excluding the side adjacent to the outlet water passage 61. Thus walls defining the exhaust passage 39 are cooled by the cooling water flowing through the water inlet 60, the inlet water passages 63 and 64, the cylinder block water jacket $J_b$ and the outlet water passage 61.

Referring to FIGS. 4 and 10, the cylinder head water jacket $J_h$ includes a combustion chamber water jacket 70 surrounding the combustion chambers 26, and an exhaust passage water jacket 71 surrounding the exhaust manifold passage 38. The water jackets 70 and 71 communicate with each other at a position near a vertical center plane containing the center axes of the cylinders C1 to C4. The combustion chamber water jacket 70 and the exhaust passage water jacket 71 are formed by water jacket cores, and the exhaust ports 28 and the exhaust manifold passage 38 are formed by exhaust passage cores in forming the cylinder head 21 in a mold by casting. Thus the combustion chamber walls $W_c$ defining the combustion chambers 26, passage walls defining the exhaust ports 28 and the passage wall $W_e$ defining the exhaust manifold passage 38 are formed integrally with the cylinder head 21.

A part of the cylinder head water jacket $J_h$ surrounding the passage wall $W_e$ defining the exhaust manifold passage 38 is referred to, for convenience, as the exhaust passage water jacket 71 and the rest of the cylinder head water jacket $J_h$ is referred to as the combustion chamber water jacket 70.

In this specification, parts and positions of the cylinder head 21 near to the cylinder block C or the combustion chambers 26 with respect to the cylinder axis direction will be referred to as near-cylinder-side parts and positions, and those far from the cylinder block C or the combustion chambers 26 with respect to the cylinder axis direction will be referred to as far-cylinder-side parts and positions. Directions perpendicular to the vertical center plane will be referred to as transverse directions. Positions near to the vertical center plane will be referred to as near-center-plane-side positions and those far from the vertical center plane will be referred to as far-center-plane-side positions. The vertical center plane contains at least the center axis of one of the cylinders C1 to C4 and is parallel to the center axis of the crankshaft 25.

Referring to FIGS. 4, 7 and 9, the exhaust passage water jacket 71 includes a far-cylinder-side water jacket 72 extending on the far-cylinder-side of the exhaust manifold passage 38, a near-cylinder-side water jacket 73 extending on the near-cylinder side of the exhaust manifold passage 38, and a side water jacket 74 extending on the far-center-plane side, namely, the right-hand side in the embodiment, of the exhaust manifold passage 38.

The far-cylinder-side water jacket 72 and the near-cylinder-side water jacket 73, which are flat with respect to the cylinder axis direction, are on the opposite sides, respectively, of the exhaust manifold passage 38 with respect to the cylinder axis direction and extend in a range corresponding to the arrangement of the cylinders C1 to C4 (or the combustion chambers 26). The cooling water flows from far-cylinder-side water jacket 72 and the near-cylinder-side water jacket 73 into the combustion chamber water jacket 70. As shown in FIG. 7, the whole far-cylinder-side water jacket 72 and the whole near-cylinder-side water jacket 73 are spaced apart from each other with respect to the cylinder axis direction in the entire range corresponding to the exhaust manifold passage 38.

The far-cylinder-side water jacket 72 and the near-cylinder-side water jacket 73 extend along the exhaust gas outlet 38*e* and have inlets 72*i* and 73*i*, respectively. The inlets 72*i* and 73*i* open in the joint surface 21*s* and connect to the second inlet water passage 63 and third inlet water passage 64 in the joint surface $C_s$.

Referring to FIGS. 7 and 10, the far-cylinder-side water jacket 72 is divided into an up-stream water jacket 72*a* and a downstream water jacket 72*b* (FIG. 1) by a partition wall 75, namely, a flow restricting means. The partition wall 75 causes the cooling water to flow from the upstream water jacket 72*a* into the combustion chamber water jacket 70 and to flow through inlet connecting passages 76 (FIGS. 5 and 9) into the side water jacket 74 serving as a bypass water jacket.

Figure 6:
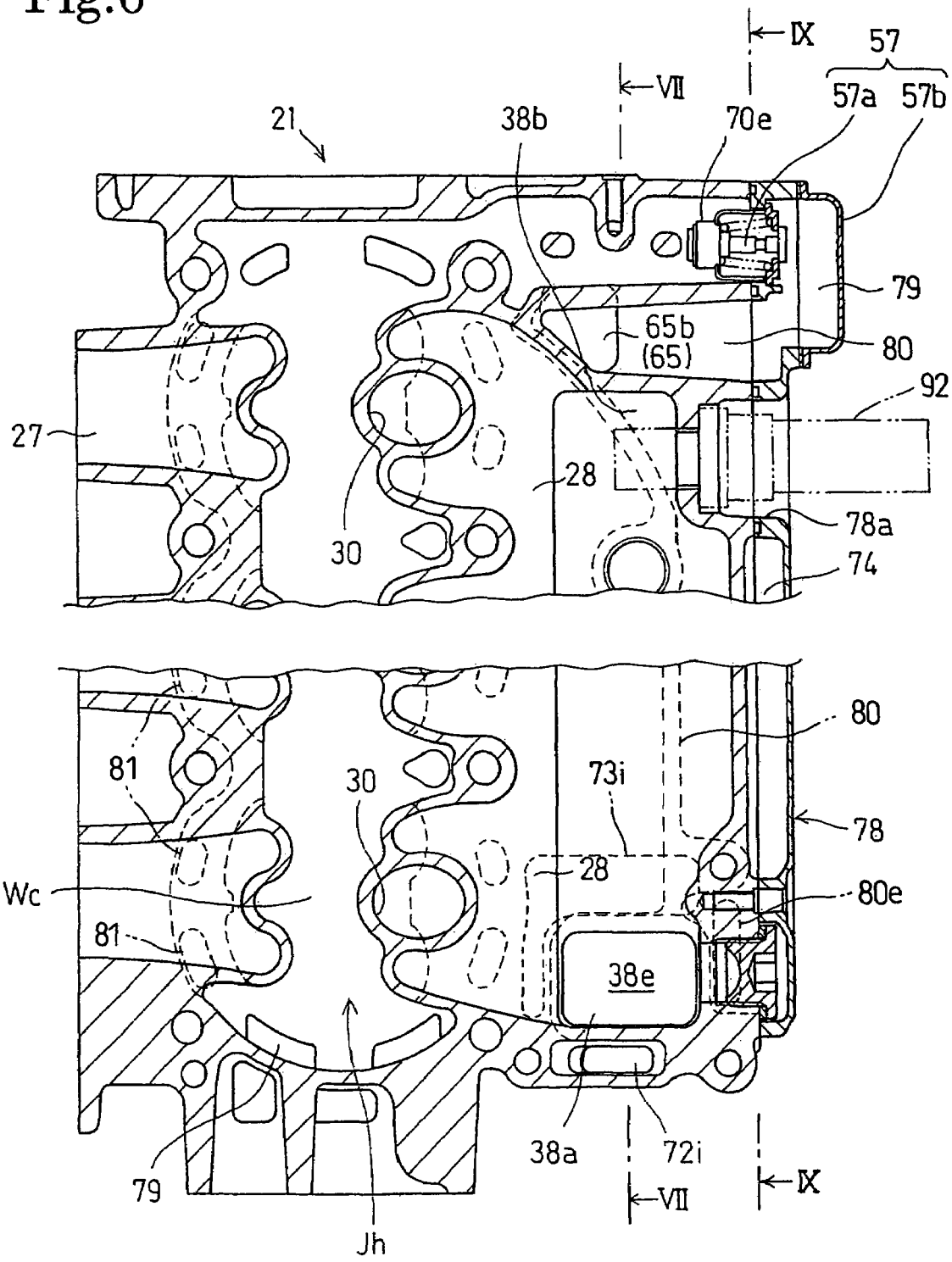
FIG. 6 is a schematic sectional view taken on the line VI-VI in FIG. 4.

Referring to FIGS. 5, 6 and 9, the side water jacket 74 communicates with the upstream water jacket 72*a* by means of the two inlet connecting passages 76 formed in the cylinder head 21 and communicates with the downstream water jacket 72*b* by means of two outlet connecting passages 77 formed in the cylinder head 21. The side water jacket 74 and the discharge water jacket 80 are defined by recesses formed in the far-center-plane-side passage wall $W_e$ and a water jacket forming cover 78 attached to the passage wall $W_e$. An electrical equipment box 93 is attached to the cover 78 as shown in FIG. 4. The electrical equipment box 98 is cooled by the cooling water flowing through the side water jacket 74.

Part of the cooling water flowing through the upstream water jacket 72*a* flows through the inlet connecting passages 76, the side water jacket 74 and the outlet connecting passages 77 into the downstream water jacket 72*b*. The cooling water flows from the downstream water jacket 72*b* through a passage on the downstream side of the partition wall 75 into the combustion chamber water jacket 70.

The cylinder water jacket 73 connects to the combustion chamber water jacket 70 at positions respectively corresponding to the combustion chambers 26 with respect to the direction in which the combustion chambers 26 are arranged. All the cooling water that has cooled the passage wall $W_e$ defining the exhaust manifold passage 38 flows into the combustion chamber water jacket 70.

Referring to FIGS. 5, 6, 9 and 10, the cooling water that has flowed through the far-cylinder-side water jacket 72, the side water jacket 74 and the near-cylinder-side water jacket 73 to cool the passage wall $W_e$ defining the exhaust manifold passage 38 flows through the outlet 70*e* of the combustion chamber water jacket 70 into a connecting passage 79 (FIG. 6) on the side of the cylinder head 21. The connecting passage 79 formed in the cover 78 to connect the cylinder head water jacket $J_h$ and the discharge water jacket 80 has an inlet connected to the outlet 70*e*, and an outlet opening into the discharge water jacket 80. The thermostat valve 57 including a valve unit 57*a* and a cover 57*b* is placed in the connecting passage 79. The thermostat 57 does not protrude upward from the cylinder head 21 in the cylinder arranging direction.

In this embodiment, the combustion chamber water jacket 70 communicates with the cylinder block water jacket $J_b$ through openings 81 (FIGS. 3 and 6) formed in the gasket. Those openings 81 may be omitted.

The discharge water jacket 80 extends parallel to the side water jacket 74 in the cylinder arranging direction in a region nearer to the cylinders C1 to C4 than the side water jacket 74. The side water jacket 80 has an outlet 80*e* (FIG. 3) opening in the joint surface 21*s* of the cylinder head 21. The discharge water jacket 80 has an inlet formed in the joint surface 21*s* and opening into the joint surface $C_s$, and an outlet opening in the joint surface $C_m$ sealed by the gasket. The discharge water jacket 80 communicates with the outlet water passage 61 through which the cooling water flows into the discharge water passage 55 (FIG. 1) formed in the mount case 1.

The connecting passages 56 and 79 connect to the upper end 80*b* of the discharge water jacket 80. The outlet water passage 61 connects to the lower end 80*a* of the discharge water jacket 80.

Referring to FIGS. 3, 6 and 7, the exhaust gas outlet 38*e* is surrounded on the four sides by the cylinder head water jacket $J_h$ and the discharge water jacket 80. More concretely, the outlets 72*i* and 73*i* are on the opposite sides of a cross section of the exhaust gas outlet 38*e* with respect to first opposite directions parallel to the cylinder arranging direction, and the inlets 73*i* and the outlet 80*e* are on the opposite sides of the cross section of the exhaust gas outlet 38*e* with respect to second opposite directions perpendicular to the first opposite directions. Thus the passage wall $W_e$ defining the exhaust gas outlet 38*e* is cooled by the cooling water flowing through the two inlets 72*i* and 73*i* and the outlet 80*e*.

The flow of the cooling water will be described mainly with reference to FIG. 10.

When the water-cooled internal combustion engine E operates, the drive shaft 9 (FIG. 1) driven by the crankshaft 25 drives the water pump 57. The water pump 57 sucks up the cooling water through the water intake 51 and pumps the cooling water into the water inlet 60. Then, the cooling water flows from the water inlet 60 through the first inlet water passage 62 into the cylinder block water jacket $J_b$ to cool the cylinders C1 to C4. If the thermostat valve 56 is open, the cooling water flows from the cylinder block water jacket $J_b$ through the connecting passage 65 into the discharge water jacket 80. Then, the cooling water flows through the outlet water passage 61 into the discharge water passage 55.

On the other hand, the cooling water pumped into the water inlet 60 flows through the second inlet water passage 63 and the third inlet water passage 64 into the upstream water jacket 72*a* of the far-cylinder-side water jacket 72 and into the near-cylinder-side water jacket 73. Part of the cooling water that has flowed into the upstream water jacket 72*a* flows from a position on the upstream side of the partition wall 75 into a part of the combustion chamber water jacket 70 surrounding the end combustion chamber 26*a* to cool walls $W_c$ defining the combustion chambers 26 and walls defining the exhaust ports 28 connecting to the combustion chambers 26. Part of the cooling water that has flowed into the upstream water jacket 72*a* flows through the inlet connecting passage 76 into the side water jacket 74, and then flows from the side water jacket 74 through the outlet connecting passage 77 into the downstream water jacket 72*b*. The wall $W_e$ defining the exhaust manifold passage 38 is cooled by the cooling water flowing through the water jackets 72*a*, 72*b*, 73 and 74. The cooling water flows from the downstream water jacket 72*b* into a part of the combustion chamber water jacket 70 surrounding the combustion chambers 26 excluding the end combustion chamber 26*a* to cool the walls $W_c$ defining the combustion chambers 26 and the walls defining the exhaust ports 28 connecting to the combustion chambers 26. The cooling water that has cooled the wall $W_e$ flows from the near-cylinder-side water jacket 73 into the combustion chamber water jacket 70 to cool the walls $W_c$ defining the combustion chambers 26. If the thermostat valve 57 is open, the cooling water flows from the combustion chamber water jacket 70 through the connecting passage 79 into the discharge water jacket 80. Then, the cooling water flows from the discharge water jacket 80 through the outlet water passage 61 into the discharge water passage 55.

Wile the water-cooled internal combustion engine E is in a warm-up operation, the thermostats valves 56 and 57 are closed and hence the cooling water does not flow through and stagnates in the cylinder block water jacket $J_b$ and the cylinder head water jacket $J_h$ to promote the warming up of the engine E. If the water pressure in the water supply passage 54 increases excessively, a relief valve, not shown, placed in the water supply passage 54 opens to discharge the surplus water into the extension case 3.

The operation and effect of the water-cooled internal combustion engine E described herein will be explained.

The exhaust manifold passage 38 in which the exhaust gas discharged from the combustion chambers 26 through the exhaust ports 28 collects is formed only in the cylinder head 21. The exhaust gas collected in the exhaust manifold passage 38 is discharged from the cylinder head 21 through the exhaust gas outlet 38*e* of the exhaust manifold passage 38. Since the exhaust manifold passage 38 is surrounded by the cylinder head water jacket $J_h$ and the discharge water jacket 80 and is formed only in the cylinder head 21, the exhaust manifold passage 38 does not need to be sealed to connect the exhaust manifold passage 38 to the exhaust ports 28. Since the exhaust gas is discharged collectively from the cylinder head 21 through the exhaust gas outlet 38*e*, only a small region around the exhaust gas outlet 38*e* needs to be sealed. In this embodiment, the exhaust gas outlet 38*e* can be sealed by fastening parts of the cylinder head 21 around the exhaust gas outlet 38*e* to the cylinder block C with the bolts B2. Thus the exhaust manifold passage 38 can be sealed by joining together the cylinder head 21 and the cylinder block C and hence any assembling work for sealing the exhaust manifold passage 38 is not necessary. Consequently, the cost of the water-cooled internal combustion engine E can be reduced. The exhaust manifold passage 38 is surrounded by the cylinder head water jacket $J_h$ and the discharge water jacket 80, and the flow of the cooling water in the cylinder head water jacket $J_h$ and the discharge water jacket 80 is not obstructed by the bolts B2. Consequently, the wall $W_e$ defining the exhaust manifold passage 38 can be efficiently cooled.

The cylinder block water jacket $J_b$ communicates with the discharge water jacket 80 by means of the connecting passage 65 in which the thermostat valve 56 is placed so as not to protrude from the cylinder block C in the cylinder arranging direction, and the cylinder head water jacket $J_h$ communicates with the discharge water jacket 80 by means of the connecting passage 79 in which the thermostat valve 57 is placed so as not to protrude from the cylinder head 21 in the cylinder arranging direction. Since the thermostat valves 56 and 57 do not protrude respectively from the cylinder block C and the cylinder head 21 in the cylinder arranging direction, the cylinder block C and the cylinder head 21 have small dimensions, respectively, with respect to the cylinder arranging direction.

The exhaust gas outlet 38*e* of the cylinder head 21 is surrounded on four sides by the cylinder head water jacket $J_h$, the inlets 72*i* and 73*i* and the outlet 80*e*. Therefore, the wall $W_e$ defining the exhaust gas outlet 38*e* can be efficiently cooled. The exhaust passage 39 of the cylinder head 21 is surrounded on four sides by the first inlet water passage 63, the second inlet water passage 64, the outlet water passage 61 and the cylinder block water jacket $J_b$. Therefore, the wall defining the exhaust passage 39 can be efficiently cooled.

What is claimed is:

1. A water-cooled internal combustion engine comprising:

an engine body having:

a cylinder block provided with a plurality of cylinders arranged in a cylinder arranging direction;

a cylinder head joined to the cylinder block and provided with a plurality of combustion chambers respectively corresponding to the cylinders and with exhaust ports connected to combustion chambers, respectively; and a water pump for pumping cooling water;

the cylinder block having a cylinder block water jacket formed therein and substantially surrounding the cylinders, the cylinder head being provided with a cylinder head water jacket formed therein and substantially surrounding the combustion chambers and the exhaust ports, and with an exhaust manifold passage into which exhaust gas flows from the combustion chambers through the exhaust ports, respectively:

wherein the exhaust manifold passage is formed only in the cylinder head and has an exhaust gas outlet through which the exhaust gas collected in the exhaust manifold passage flows out from the cylinder head; and the exhaust manifold passage is surrounded by the cylinder head water jacket and a discharge water jacket, the discharge water jacket being formed in the cylinder head and connected to the cylinder block water jacket and the cylinder head water jacket in such a manner that cooling water from the cylinder block water jacket and the cylinder head water jacket is discharged to the outside of the engine body through the discharge water jacket;

wherein the cylinder block water jacket communicates with the discharge water jacket by means of a cylinder block connecting passage in which a cylinder block thermostat valve is disposed; and wherein the cylinder head water jacket communicates with the discharge water jacket by means of a cylinder head connecting passage in which a cylinder head thermostat valve is disposed.

2. The water-cooled internal combustion engine according to claim 1, wherein:

the cylinder block is provided with a cylinder block exhaust passage connecting to the exhaust gas outlet, in a joint surface of the cylinder block to which the cylinder head is joined; and the cylinder block exhaust passage is surrounded on four sides by a supply water passage through which the cooling water pumped by the water pump is supplied into the cylinder head water jacket, a discharge water passage through which the cooling water from the discharge water jacket flows, and the cylinder block water jacket.

3. The water-cooled internal combustion engine according to claim 1, wherein the discharge water jacket is formed between a recess formed in a wall defining the exhaust manifold passage in the cylinder head, and a cover attached to the cylinder head so as to cover the recess.

4. A water-cooled internal combustion engine comprising:

an engine body having:

a water pump for pumping cooling water;

cylinder block provided with a plurality of cylinders arranged in a cylinder arranging direction, the cylinder block having a cylinder block water jacket surrounding the cylinders; and cylinder head joined to the cylinder block and provided with:

a plurality of combustion chambers respectively corresponding to the cylinders and with exhaust ports respectively connected to combustion chambers, a cylinder head water jacket surrounding the combustion chambers and the exhaust ports, a discharge water jacket formed in the cylinder head, and an exhaust manifold passage into which exhaust gas flows from the combustion chambers through the exhaust ports, respectively;

wherein:

the exhaust manifold passage is formed only in the cylinder head and has an exhaust gas outlet through which the exhaust gas collected in the exhaust manifold passage flows out from the cylinder head;

the exhaust manifold passage is surrounded by the cylinder head water jacket and the discharge water jacket connected to the cylinder block water jacket and the cylinder head water jacket in such a manner that cooling water from the cylinder block water jacket and the cylinder head water jacket is discharged to the outside of the engine body through the discharge water jacket;

wherein the cylinder block water jacket communicates with the discharge water jacket by means of a cylinder block connecting passage, in which a cylinder block thermostat valve held so as not to protrude from the cylinder block in the cylinder arranging direction; and wherein the cylinder head water jacket communicates with the discharge water jacket by means of a cylinder head connecting passage, in which a cylinder head thermostat valve is held so as not to produce from the cylinder head in the cylinder arranging direction.

5. The water-cooled internal combustion engine according to claim 4, wherein:

the cylinder block is provided with a cylinder block exhaust passage connecting to the exhaust gas outlet, in a joint surface of the cylinder block to which the cylinder head is joined; and the cylinder block exhaust passage is substantially surrounded on four sides by a supply water passage through which the cooling water pumped by the water pump is supplied into the cylinder head water jacket, a discharge water passage through which the cooling water from the discharge water jacket flows, and the cylinder block water jacket.

6. The water-cooled internal combustion engine according to claim 4, wherein the discharge water jacket is formed between a recess formed in a wall defining the exhaust manifold passage in the cylinder head, and a cover attached to the cylinder head so as to cover the recess.

7. A water-cooled internal combustion engine, comprising:

an engine body having:

a cylinder block provided with a plurality of cylinders arranged in a cylinder arranging direction, and a cylinder head joined to the cylinder block and provided with a plurality of combustion chambers respectively corresponding to the cylinders and with exhaust ports connected to the combustion chambers, respectively;

the cylinder block having therein a cylinder block water jacket surrounding the cylinders, the cylinder head being provided therein with a cylinder head water jacket surrounding the combustion chambers and the exhaust ports, and with an exhaust manifold passage into which exhaust gas flows from the combustion chambers through the exhaust ports, respectively; and a water pump for pumping cooling water to the cylinder block water jacket and the cylinder head water jacket;

wherein the exhaust manifold passage has an exhaust gas outlet through which the exhaust gas collected in the exhaust manifold passage flows out from the cylinder head;

wherein the exhaust manifold passage is surrounded by the cylinder head water jacket, and a discharge water jacket is formed in the cylinder head to surround the exhaust manifold passage, the discharge water jacket being connected to the cylinder block water jacket and the cylinder head water jacket in such a manner that cooling water from the cylinder block water jacket and the cylinder head water jacket is discharged to the outside of the engine body through the discharge water jacket;

wherein the cylinder block water jacket communicates with the discharge water jacket by means of a cylinder block connecting passage, in which a cylinder block thermostat valve is held so as not to protrude from the cylinder block in the cylinder arranging direction; and wherein the cylinder head water jacket communicates with the discharge water jacket by means of a cylinder head connecting passage, in which a cylinder head thermostat valve is held so as not to protrude from the cylinder head in the cylinder arranging direction.

8. The water-cooled internal combustion engine according to claim 7, wherein:

the cylinder block is provided with a cylinder block exhaust passage connecting to the exhaust gas outlet, in a joint surface of the cylinder block to which the cylinder head is joined; and the cylinder block exhaust passage is substantially surrounded on four sides by a supply water passage through which the cooling water pumped by the water pump is supplied into the cylinder head water jacket, a discharge water passage through which the cooling water from the discharge water jacket flows, and the cylinder block water jacket.

9. The water-cooled internal combustion engine according to claim 7, wherein the discharge water jacket is formed between a recess formed in a wall defining the exhaust manifold passage in the cylinder head, and a cover attached to the cylinder head so as to cover the recess.

* * * * *